US005129248A

United States Patent [19]

Yasui

[11] Patent Number: 5,129,248

[45] Date of Patent: Jul. 14, 1992

[54] GAS MASS SUPERPLASTIC FORMING

[75] Inventor: Ken K. Yasui, Fountain Valley, Calif.

[73] Assignee: McDonnell Douglas Corporation, Long Beach, Calif.

[21] Appl. No.: 636,791

[22] Filed: Jan. 2, 1991

[51] Int. Cl.[5] ..... B21D 26/02

[52] U.S. Cl. ..... 72/60; 72/20; 72/342.1; 72/709

[58] Field of Search ..... 72/20, 38, 60, 342, 72/364, 709

[56] References Cited

U.S. PATENT DOCUMENTS 4,233,829 11/1980 Hamilton et al. ..... 72/60
4,352,280 10/1982 Ghosh ..... 72/60
4,708,008 11/1987 Yasui et al. ..... 72/60
5,007,265 4/1991 Mahoney et al. ..... 72/60

FOREIGN PATENT DOCUMENTS 150085 1/1962 Japan ..... 72/60
197021 8/1989 Japan ..... 72/60
210130 8/1989 Japan ..... 72/709

*Primary Examiner*—David Jones
*Attorney, Agent, or Firm*—James M. Skorich; John P. Scholl; Gregory A. Cone

[57] ABSTRACT

An apparatus and method for controlling the superplastic forming process by measuring and controlling the gas mass flow rate of the gas displacing the blank being formed.

7 Claims, 1 Drawing Sheet

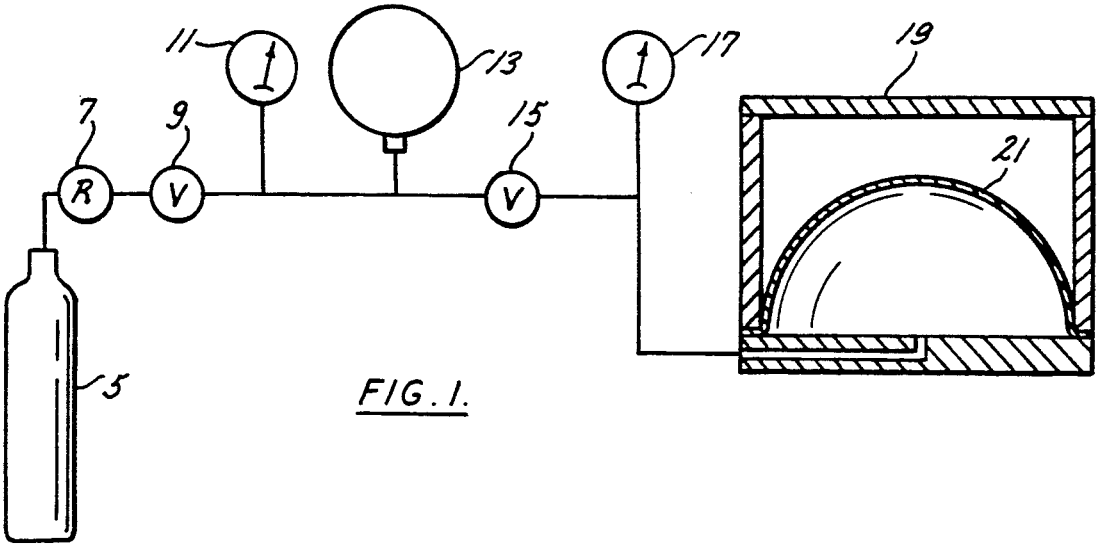
FIG. 1.
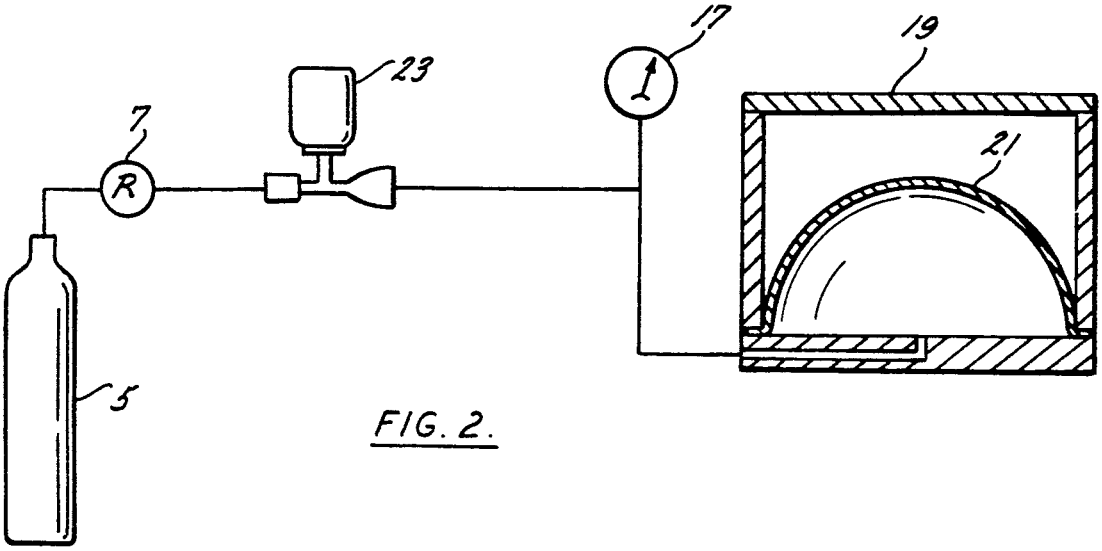
FIG. 2.
FIG. 3.
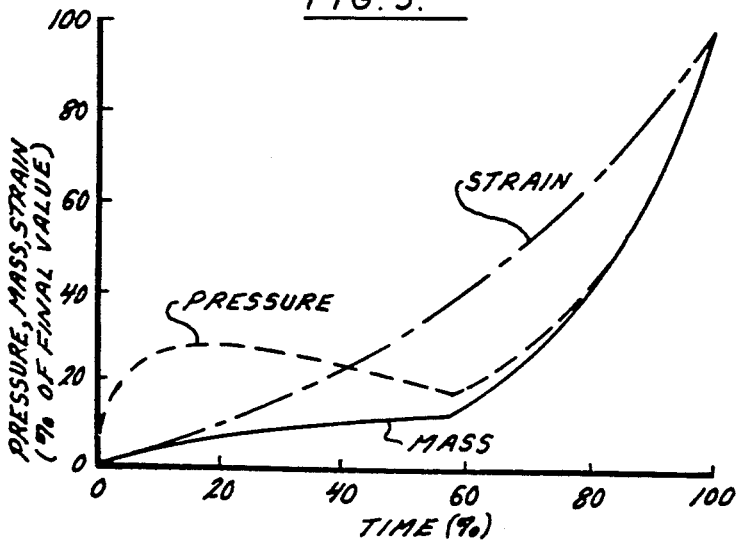

GAS MASS SUPERPLASTIC FORMING

BACKGROUND OF THE INVENTION

This invention relates to the field of metal forming and, more particularly, to the forming of metals which exhibit superplastic characteristics.

Superplasticity is the characteristic demonstrated by certain metals which exhibit extremely high plasticity in that they develop unusually high tensile elongations with minimum necking when deformed within limited temperature and strain rate ranges. The methods, applicable to the teachings of this invention, used to form the superplastic materials capitalize on these characteristic and typically employ gas pressure to form sheet material into or against a configurational die in order to form the part. diffusion bonding is frequently associated with the process. U.S. Pat. No. 3,340,101 to D. S. Fields, Jr. et al, U.s. Pat. No. 4,117,970 to Hamilton et al, U.s. Pat. No. 4,233,829 also to Hamilton et al, and U.s. Pat. No. 4,217,397 to Hayase et al are all basic patents, with various degrees of complexity, relating to superplastic forming. All of these references teach a process which attempts to control stress, and thereby strain, by controlling the pressure in the forming process versus time.

One exception to controlling forming rates by controlling pressure versus time is taught in U.s. Pat. No. 4,708,008 to Yasui et al. Yasui is also the named inventor herein with the same assignee as the reference. The Yasiui reference teaches measuring and controlling the volume displaced by the blank being formed so as to measure total strain or surface area increase of the blank.

U.S. Pat. No. 4,489,579 to Daime et al also control the process by controlling pressure versus time but also teaches additional devices for monitoring the forming rate by providing a tube which penetrates the die and engages a portion of the blank to be formed. As the blank is formed, the tube advances through the die directly as that portion of the blank is formed. Means are also provided to produce a signal at predetermined amounts of advancement of the tube and, further, electrical contacts are provided at recess angles of the die and the switch is closed when the blank being formed, it provides for monitoring the forming step which allows the operator to evaluate the development process of the part. However, it is not very practical to have a sliding tue probe with the associated geometric disturbance at the contact point nor is it practical to provide electrical instrumentation in this harsh environment.

Keep in mind that excessive strain rates cause rupture and must be avoided in the forming process. In order to understand excessive strain rates it is necessary to understand the relationship between the variables in superplastic forming which are represented by the classic equation:

$$\delta - K\dot{\epsilon}m$$

where m is the strain rate sensitivity, $\delta$ is stress, $\dot{\epsilon}$ is strain rate, and K is a constant.

In the absence of strain hardening, the higher the value of m, the higher the tensile elongation. Solving the classic equation for m, $$m = \frac{\ln\delta - \ln K}{\ln\dot{\epsilon}}$$

In addition to strain rate, the value of m is also a function of temperature and microstructure of the material. The uniformity of the thinning under biaxial stress conditions also correlates with the value of m. For maximum deformation stability, superplastic forming is optimally performed at or near the strain rate the at produces the maximum allowable strain rate sensitivity. However, because the strain rate sensitivity, m, varies with temperature as well as stress and microstructure, m is, as a practical matter, constantly varying during the process.

Furthermore, the strain rate varies at different instances of time on different portions of the formation inasmuch as stress levels are non uniform. The more complex the part, the more variation there is, and, therefore, strain rate differs over the various elements of the formation. Since strain rate, stress, temperature and microstructure are all interdependent and varying during the process, the relationship is theoretical. As a practical matter, there is no predictable relationship which can be controlled so as to form all portions of complex parts at the optimum strain rate sensitivity and therefore the optimum strain rates. However, the artisan can plot strain rate sensitivity (m) against strain rate ($\epsilon$) and stress ($\rho$) against strain rate ($\dot{\epsilon}$) and establish the best compromise ranges to be caused as guides. Those skilled in the rt must then select and control those portions of the formation which are more critical to successful forming while maintaining all other portions at the best or less than the best strain rates which necessarily becomes the overall optimum rate.

This is further complicated for deep forming, which requires forming pressure reduction due to the higher thinning rate of the material, if during the forming process, the blank may not be exactly where it is thought to e at any given time int the forming process. For example, FIG. 3 shows a typical pressure versus time curve for forming a cylinder having a bottom. The discontinuity in the ideal pressure and mass flow curves at approximately 58% of the total time is where the bottom portion of the cylinder being formed first touches the fixture. Obviously greater stress is required to form the balance of the specimen. What is critical is to pick the point where the slop changes and the two slopes could be a straight line or a linear flow rate. However, the pressure is actually reducing between the 20% and the 58% points on the time abscissa. In other words, if a simple cylinder was being formed as shown in the Figures and the artissman has determined by an analysis, as discussed above, that after a period of time $t_1$ (58% time in FIG. 3) the blank has formed to the extent that the spherical portion has touched the upper portion of the configurational die the normal process would demand an increase in forming pressure to from the recess corner between the wall and bottom of the cylinder. If for some reason the spherical portion of the forming blank had not, as anticipated, reached the fixture the programmed pressure increase would cause an excessive strain rate as the specimen should be still forming at the lower pressure. Since the process is being pressure controlled, the system will respond and accelerate the strain rate until rupture occurs.

By controlling the process by either volume or pressure alone only one of the variables in Boyle's Law $$\frac{P_1 \times V_1}{T_1} = \frac{P_2 \times V_2}{T_2}$$

(where P, V, and T represent pressure, volume, and temperature, respectively) is used to control the process. Even though Daime et al teaches an aid to measure critical displacement the reference still teaches controlling the process by controlling pressure. Further, as previously indicated, the sliding, protruding tubes from the fixture in the forming environment is not practical, particularly where the part is complex and would require many protruding tubes.

It is an object of the present invention to provide a method for controlling superplastic forming processes which is self-correcting in that if the part strain rate increase, the forming rate self-adjusts because the resulting increase in volume of the specimen a being formed acts to reduce the forming pressure.

It is a further object of this invention to control all the variables in Boyle's Law during the forming process.

SUMMARY OF THE INVENTION

In summary, this invention teaches controlling the superplastic forming process by controlling the mass flow of the forming gas.

BRIEF DESCRIPTION OF THE DRAWINGS

FIG. 1 schematically shows a forming apparatus and the associated accumulator type controlling device;

FIG. 2 is an alternate controlling device using a gas mass flow meter; and

FIG. 3 is a typical forming curve for a cylinder with a bottom.

DESCRIPTION OF THE PREFERRED EMBODIMENT

No matter what method is used to control the forming process initial analytical steps in the forming analysis are required. The relationship between stress, $\rho$, and strain rate, $\epsilon$, at the forming temperature for any given material must be established either analytically or experimentally by methods well known int heart. Using this data, total deformation of the part being formed can be approximated by analyzing the geometry of the particular pat being formed as a function of applied stress. Unquestionably, a very accurate stress versus time curve can usually be established for even very complex structures. However, this analysis is very time consuming in light of the manly variables and is subject to deviations in the material and process parameters. The substantial benefit of gas mass flow control as compared to pressure control is realized in the detail and amount of analysis required. In pressure control this analysis needs to be quite accurate and rigorous where in gas mass flow control all that is required is a determination of critical points. This can be done quite easily by one skilled int the art. Again, this occurs in gas mass flow control because stress is indirectly controlled along with al the gas variables and a high strain will automatically reduce stress.

FIG. 1 is a schematic of a simple apparatus which may be used to control the mass flow of the gas used in superplasticity forming a blank. The gas source 5, usually argon gas, is fed through a pressure regulator 7 followed by a shut-off valve 9. Next is a pressure gage 11 which reads the pressure in the accumulator 13 which is sized according to the forming part cavity volume. The smaller the accumulator volume, the more precisely the accumulator pressure changes, however, it needs more frequent gas refilling from the gas source 5. In fact, more than one accumulator may be sued provided it is isolated from the system with a manual or electrical shut-off valve. The valve 15 is used as the throttling valve to control the gas flow from the accumulator 13 through the base of configurational die 19 into the specimen being formed 21. The forming pressure may be read on the gage 17. In this apparatus the accumulator is initially pressurized to a predetermined pressure of peg as source 5 by opening valve 9 and having the pressure regulator set at a predetermined controlling pressure. Once the accumulator is charged to the predetermined pressure at a known temperature and volume the mass of the gas in the accumulator is readily calculated. The system is isolated by closing valve 9 and then bleeding down the pressure in accumulator 13 to a precalculated pressure in predetermined rate, thereby controlling the mass flow to predetermined amounts in short intervals with less pressure change. When the accumulator pressure drops to the predetermined level, valve 15 is closed to isolate the system and valve 9 opened and the accumulator 13 is recharged to the predetermined pressure and thereby a predetermined mass, and the procedure is repeated. The apparatus controls the mass flow in predetermined time intervals.

Of course, the accumulator 13 and the shut-off valve 9 and throttling valve 15 may be replaced by a mass flow meter and the process controlled directly form the regulator 7. The latter embodiment is shown schematically in FIG. 2, wherein mass flow meter 23 is located in between pressure regulator 7 and configurational die 19. A suitable mass flow meter for this purpose is the Series 2000L available from TSI, Inc., St. Patul, MN. The specific model required is determined bu the mass flow bane required to form the specific specimen. Obviously, a more sophisticated system may be provided with a programmable mass flow controller. The specific arrangement is not the subject of this invention.

Numerous modifications and variations of the present invention are possible in light of the above teachings. It is therefore to be understood that within the scope of the appended claims, is any way that gas mass flow is controlled to the blank being formed.

What is claimed is:

1. An apparatus for superplasticity deforming a blank into a part having a shape, comprising:

a configurational die having a contour which is complementary to the shape of the part to be formed;

means for holding said blank in said configurational die at forming temperatures;

a pressurized gas which is flowable into said configurational die at a gas mass flow rate;

means for introducing said pressurized gas into said configurational die to create a differential gas pressure against opposing sides of said blank so as to form said blank into said configurational die; and means for measuring the gas mass flow rate of said pressurized gas as it flows into said configurational die so that the gas mass flow rate can be controlled.

2. The apparatus of claim 1 wherein said means for measuring the gas mass flow rate is an accumulator for storage of a predetermined mass of said as, a throttling valve for controlling a first flow of said gas from said accumulator into said configurational die, and a shut-off valve for controlling a second flow of said gas into said accumulator.

3. The apparatus of claim 1 wherein said means for measuring the gas mass flow rate is a mass flow meter.

4. A method of deforming a metal blank into a part having a shape, which comprises:

holding said blank in a configurational die having a contour which is complimentary to the shape of the part to be formed;

introducing a pressurized gas into said configurational die, so as to create a differential pressure across said blank and deform said blank into said configurational die; and measuring and controlling a mass flow rate of said pressurized gas flowing into said configurational die so as to control the deformation of said blank.

5. The forming method of claim 4 wherein said step of measuring and controlling the gas mass flow rate includes filling an accumulator having a known volume with said gas and subsequently exhausting said gas into said configurational die.

6. The forming method of claim 4 wherein said step of measuring and controlling the gas mass flow rae includes forcing said gas through a mass flow meter.

7. The apparatus of claim 2 wherein said shut-off valve and said throttling valve are never simultaneously open.

* * * * *